United States Patent [19]

Baur et al.

[11] 3,952,339

[45] Apr. 27, 1976

[54] AUTOMATIC TOILET CLEANING DEVICE

[75] Inventors: Edmund Baur, Ratingen; Bernd-Dieter Holdt, Dusseldorf; Hans Werner Ratering, Sturzelberg; Georg Thesing, Monheim; Erich Turk, Langenfeld-Reusrath, all of Germany

[73] Assignee: Henkel & Cie G.m.b.H., Dusseldorf, Germany

[22] Filed: Sept. 23, 1974

[21] Appl. No.: 508,053

[30] Foreign Application Priority Data

Sept. 29, 1973 Germany ..... 2349067

[52] U.S. Cl. ..... 4/228; 4/227

[51] Int. Cl.[2] ..... E03D 9/04; E03D 9/02

[58] Field of Search ..... 4/228, 227, 231, 222, 4/223; 222/56, 61, 62, 194, 204, 416, 442, 444, 464, 540

[56] References Cited

UNITED STATES PATENTS

| | | | |
|---|---|---|---|
| 991,825 | 5/1911 | Bogie | 4/228 |
| 1,213,978 | 1/1917 | Thornton | 4/227 |
| 1,987,689 | 1/1935 | Lewis | 222/464 X |
| 2,570,934 | 10/1951 | Foster | 4/228 |
| 3,769,640 | 11/1973 | Castronovo | 4/228 |

FOREIGN PATENTS OR APPLICATIONS

| | | | |
|---|---|---|---|
| 26,284 | 11/1899 | United Kingdom | 4/228 |

*Primary Examiner*—Richard E. Aegerter
*Assistant Examiner*—Larry Jones
*Attorney, Agent, or Firm*—Hammond & Littell

[57] ABSTRACT

This invention concerns an automatic toilet cleaning device which is manufactured from a solid material such as metal, or preferably from plastics, and which consists of a container for a solid cleanser to be dissolved, a cover, a suspension means, as well as inlet means and outlet means for the flushing water.

4 Claims, 3 Drawing Figures

AUTOMATIC TOILET CLEANING DEVICE

THE PRIOR ART

Toilet cleaning devices of this automatic type are known in the prior art. However, the known devices have the disadvantage that a more or less changing amount of the cleanser is metered or dosed into the flushing water because of the uncontrolled flow of the flushing water in the water container in which the dissolving of the cleanser takes place. The dissolution of the cleanser depends to a great extent upon the process of diffusion. In addition, the residence time of the flushing water in the water container varies over a broad range. Consequently it is necessary to take into account that there are zones in which dissolution of the cleanser by movement of the flushing water does not take place at all. Instead the dissolution only occurs by diffusion, which is well known to proceed very slowly.

OBJECTS OF THE INVENTION

It is an object of the present invention to improve the prior art automatic toilet cleaning devices so that with each flushing operation, as equal an amount of the cleanser as possible is dissolved by the flushing water and is flushed into the water tank.

It is a further object of the present invention to provide an improvement in an automatic toilet cleaning device which is manufactured from a solid material such as metal, or preferably from plastics, and which consists of a container for a solid cleanser to be dissolved, a cover, a suspension means, as well as inlet means and outlet means for the flushing water, wherein the improvement comprises the folowing combination of a. said container having an essentially oval cross-section with an even flat side-wall, and said container having a specific gravity higher than that of water;

b. a standpipe adapted for conducting flushing water, said standpipe being open at the top and at the bottom, said standpipe being attached to approximately the center of said ovally curved side of said container;

c. said standpipe having a height of about 80 percent of the height of said container and having at its upper end a free-space i.e., open cross-sectional area of about 2 to 10 $mm^2$;

d. said cover being seated tightly fitting onto said container and having two holes which are located at about the same distance from the standpipe as well as being close to said even flat side-wall, and said holes being a distance from each other that is equal to or greater than the distance to the standpipe, and said cover having a specific gravity lower than that of water.

These and further objects of the present invention will become apparent as the description thereof proceeds.

THE DRAWINGS

The following drawings are merely illustrative of the present invention without being deemed limitative in any manner thereof, in which.

DESCRIPTION OF THE INVENTION

Figure 2:
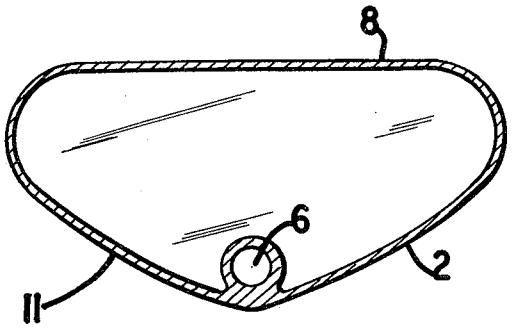
FIG. 2 is a cross-section along line II—II of FIG. 1.

The invention concerns an improvement in an automatic toilet cleaning device which is manufactured from water-insoluble solid material such as metal, or preferably from plastics, and which consists of a container adapted for holding a solid cleanser to be dissolved, a cover for said container, a suspension device or means for holding said device in a water tank, as well as inlet means and outlet means adopted for conducting the flushing water.

The improvement according to the invention is distinguished by the following conbination of features:

a. The container has an essentially oval cross-section with an even, or flat, side-wall and has specific gravity higher than that of water.

b. Attached to approximately the center of the ovally curved side of the container is a standpipe adapted for conducting flushing water, said standpipe being open at the top and at the bottom.

c. The standpipe has a height which is equal to about 80 percent of the height of the container; and at its upper end, the standpipe has an open cross-sectional area of about 2 to 10 $mm^2$.

d. The cover is seated tightly fitted onto the container and has two holes therein which are positioned at about the same distances from the standpipe, as well as being close to the even flat side-wall, and which are a distance from each other that is equal to or greater than the distance from the standpipe; and the cover has a specific gravity lower than that of water.

The device according to the invention provides a further improvement over the prior art automatic toilet cleaning devices, because with each flushing operation, as equal an amount of the cleanser as possible is dissolved by the flushing water and is flushed into the water tank.

The device according to the invention has the advantages of providing a whirling effect which is unexpectedly produced by the oval shape of the cross-section of the container having an even or flat side-wall, and by the arrangement according to the invention by which the standpipe for the flushing water is open at the top and the bottom and is located in the center of the ovally curved side of the container. This unexpected whirling effect results in causing the already dissolved portions of the cleanser to mix well with the water flowing into the container. In turn, this results in an improved dissolution of the solid cleanser in the flushing water and therewith, results in an improved diffusion.

The mixing and dissolving process chiefly takes place in the upper part of the container for the cleanser. Hence, according to the invention, the standpipe has a height which is equal to about 80 percent of the height of the container and thus, leaves a free-space in the upper part of the container. Furthermore, the standpipe advantageously has an open cross-sectional area of about 2 to 10 $mm^2$ at its upper end, preferably about 6 $mm^2$. Thus when the increase in the level of the water in the tank causes the flushing water to flow into the container through the standpipe, this flow is optimally adapted for dissolving the amount of the solid cleanser to be dissolved in each case. The container is made from a water-insoluble solid material such as metal for example aluminum, magnesium, or iron coated so as not to rust, or such as a plastic for example a thermoplastic resin such as polyvinylidene chloride or a thermosetting resin such as a phenolformaldehyde resin.

Plastics are preferred, and especially plastics having a specific gravity heavier than that of water.

In order that the intended favorable flow conditions and dissolution conditions prevail within the container, the container sealed by the cover is suspended below the water level in the water tank, filled with flushing water. This can be achieved in a simple manner when the container is made of a plastic which has a specific gravity higher than that of water, whereas the material of the cover has a specific gravity lower than that of water. The solid cleanser present in the container is known to have specific gravity which is almost equal to that of water.

Air in the container is displaced by the flushing water flowing into the container through the standpipe, as the level of the water rises in the water tank. This displaced air can escape through the two holes in the cover which are located at an equal distance from the standpipe as well as being close to the side-wall. The distance of the holes from each other is equal to or greater than the distance from the standpipe. This positioning of the two holes likewise augments the mixing effect in the container, especially when the container is completely filled with water, and when the water which is already enriched with the cleanser flows out into the water tank through the two holes in the cover.

When the flushing device is operated, the level of the flushing water steadily decreases so that the water that is present in the container and which contains the dissolved cleanser can also flow into the water tank through the standpipe and mix with the flushing water present in the tank. This process proceeds automatically and is repeated each time the flushing device is activated. By way of explanation, a toilet cleaning device according to the invention is now described by reference to the drawings.

Figure 3:
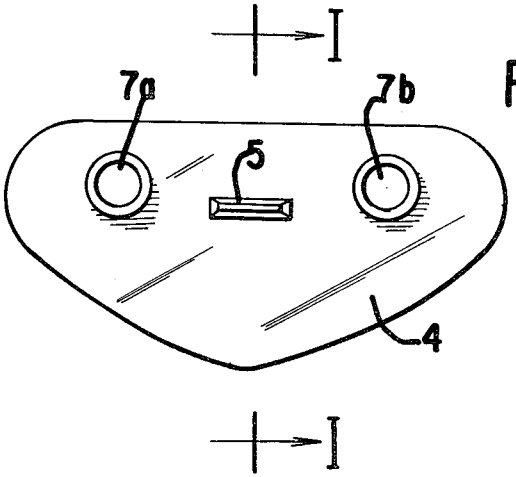
FIG. 3 is a top view of the cleaning device of the invention.

The plastic toilet cleaning device 1 (FIG. 1) consists of the container 2 for dissolving the solid cleanser 3, the cover 4, the suspension device 5, and the standpipe 6, as well as the holes 7 situated in the cover (FIG. 3) 4.

Figure 1:
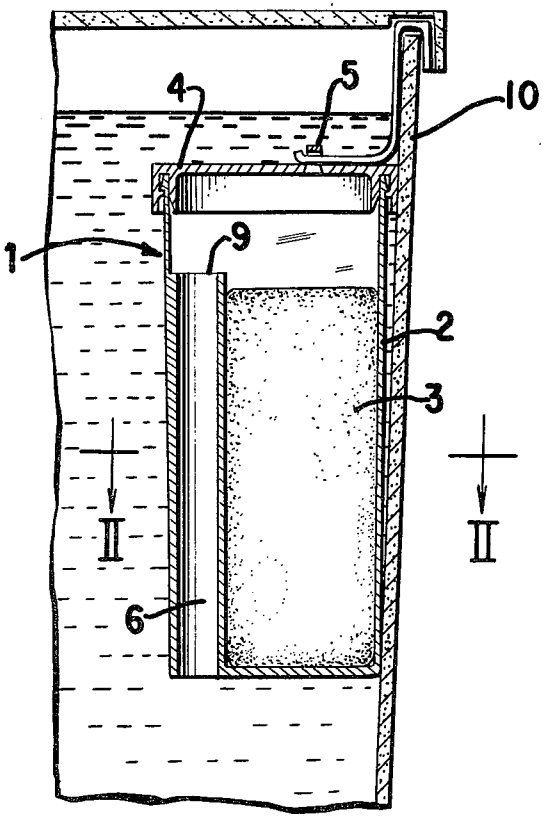
FIG. 1 is a longitudinal cross-section of the cleaning device of the invention.

The container 2 (FIGS. 1 and 2) of the automatic toilet cleaning device which has been suspended in the water tank 10 has been designed with an essentially oval cross-section and possesses the flat or even side-wall 8. In the center of the ovally curved side 11 of the container, there is attached the standpipe 6 which has a height amounting to about 80% of the height of the container 2 (FIG. 1). When the flushing water flows through the standpipe 6, the relative disposition of the standpipe together with the holes 7 produces a whirling effect in the upper part of the container 2 whereby the dissolution and therewith, the diffusion of the solid cleanser 3 is considerably promoted.

The standpipe 6 has at its upper end 9 a free-space cross-sectional area of about 6 $mm^2$ which determines the amount of the water flowing into the container.

When the flushing device is activated, the level of water in the water tank 10 decreases so that the flushing water present in the container 2 which has been enriched with the cleanser can again flow through the standpipe 6 into the water tank 10 and mix with the water present in the water tank. An additional advantage of the device according to the invention is that the thus controlled flowing conditions of the flushing water enriched with cleanser effect a pre-proportioning of the fresh water flowing into the water tank after the preceding emptying. This effect is brought about because a certain amount of the flushing water enriched with the cleanser still drips from the standpipe 6 and immediately mixes with the fresh water flowing into the water tank 10.

The subsequent increase of the water level in the water tank 10 causes flushing water to flow again into the container 2 through the standpipe 6. The air thereby displaced escapes through the holes **7*a* and 7*b*. The distance of the holes 7*a* and 7*b* from each other is equal to or greater than the distance to the standpipe, hence, the mixing effect in the container 2 is initiated again by the returning water flow. When the container 2 is completely filled with water, the water flowing in through the standpipe 6 is forced to change its direction and to leave the container 2 through two holes 7*a* and 7*b* in the cover 4. However, its uniform distribution over the cross-section of the container 2** is substantially maintained.

The filling and emptying of the container 2 and therewith, the dissolution of the solid cleanser is automatically repeated with each filling and emptying of the water tank until the cleanser 3 has been consumed.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

We claim:

1. In an automatic toilet cleaning device made of a solid water-insoluble material consisting essentially of a container adapted for holding a solid cleanser to be dissolved, a cover for said container, a suspension means for holding said device in a water tank, an inlet means and an outlet means adapted for conducting flushing water, the improvement which comprises the combination of:

a. said container having an essentially oval cross-section with an even flat side-wall, and said container having a specific gravity greater than that of water;

b. a standpipe adapted for conducting flushing water, said standpipe being open at the top and at the bottom; said standpipe being attached to approximately the center of said ovally curved side of and within said container;

c. said standpipe having a height of about 80% of the height of said container and having at its upper end an open cross-sectional area positioned above said standpipe of about 2 to 10 $mm^2$;

d. said cover being seated tightly fitting onto said container and having two holes which are located at about the same distance from the standpipe as well as being close to said even flat side-wall, and said holes being a distance from each other that is equal to or greater than the horizontal distance to the standpipe, and said cover having a specific gravity lower than that of water.

2. The automatic toilet cleaning device of claim 1, wherein said solid water-insoluble material is selected from the group consisting of metals and plastics.

3. The automatic toilet cleaning device of claim 1, wherein said solid water-insoluble material is a plastic.

4. The automatic toilet cleaning device of claim 1, wherein said standpipe has at its upper end an open cross-sectional area of about 6 $mm^2$.

* * * * *